US005634830A

United States Patent [19]

Weingartner

[11] Patent Number: 5,634,830

[45] Date of Patent: Jun. 3, 1997

[54] CONTACT ELEMENT FOR ELECTRICAL CONNECTORS

[75] Inventor: Bernhard Weingartner, Feldkirch, Austria

[73] Assignee: Neutrik Aktiengesellschaft, Schaan, Liechtenstein

[21] Appl. No.: 419,386

[22] Filed: Apr. 10, 1995

[30] Foreign Application Priority Data

May 13, 1994 [DE] Germany ..... 44 16 888.8

[51] Int. Cl.[6] ..... H01R 11/22

[52] U.S. Cl. ..... 439/857

[58] Field of Search ..... 439/857, 856, 439/65, 609

[56] References Cited

U.S. PATENT DOCUMENTS

| | | | |
|---|---|---|---|
| 3,696,319 | 10/1972 | Olsson | 439/857 |
| 3,812,452 | 5/1974 | Sturm | 439/857 |
| 5,022,871 | 6/1991 | Sekiguchi | 439/609 |

FOREIGN PATENT DOCUMENTS

| | | | |
|---|---|---|---|
| 000459680 | 12/1991 | European Pat. Off. | 439/65 |

*Primary Examiner*—Neil Abrams
*Assistant Examiner*—Eugene G. Byrd
*Attorney, Agent, or Firm*—McAulay Fisher Nissen Goldberg & Kiel, LLP

[57] ABSTRACT

The contact element for electrical connectors, in particular for audio connectors, is stamped out of a starting material in sheet form. It has two fork-like legs having projections directed opposite one another at their free ends for the purpose of making contact diametrically with a contact element in the shape of a pin or strip which can be inserted between the fork-like legs. The contact-making boundary edges of the projections extend in a straight line. When the contact element is not loaded, these straight boundary edges enclose an acute angle with the center axis of the contact element, which acute angle corresponds to the deflecting angle of the legs when the pin-shaped or strip-shaped contact element is inserted. The portion of the contact element remote of the projections is constructed as a curve and a web leading to the terminal lug of the contact element adjoins the central portion of this curve. The contact element is substantially shaped like a tuning fork.

14 Claims, 1 Drawing Sheet

CONTACT ELEMENT FOR ELECTRICAL CONNECTORS

BACKGROUND OF THE INVENTION a) Field of the Invention

The invention is directed to a contact element for electrical connectors, in particular audio connectors, which is stamped out of a starting material in sheet form and has two fork-like legs having projections directed opposite one another at the free ends of the legs for the purpose of making contact diametrically with a contact element in the shape of a pin or strip which can be inserted between the fork-like legs.

b) Description of the Related Art

Contact elements of this type are known, for example, from U.S. Pat. No. 5,022,871. In this contact element known from the prior art, the projections which are directed opposite one another are rounded off in a curved manner so that the contact-making projection has punctiform contact at the inserted contact element which can be constructed as a strip or pin. The rear portion of this known contact element with the legs arranged in the manner of a fork passes into a strip whose width corresponds approximately to the width of the portion with the fork-like legs. Although contact elements of this type are used in overwhelmingly large quantities, there are disadvantages attached: high surface pressure occurs due to the punctiform contact. Because of the high surface pressure required in this case, it cannot be ruled out that the surface of the contact element to be inserted, which is almost always provided with an electrodeposited precious-metal coating (Ag, Au, alloys)—usually in a very thin layer—will be affected by removal of the protective layer resulting in a gradual deterioration of the contact resistance in the contact area or in a drastic increase in susceptibility to corrosion. In addition, high current density occurs in punctiform contact.

OBJECT AND SUMMARY OF THE INVENTION

Proceeding from the prior art cited above, the primary object of the present invention is to improve a contact element of this type in such a way that surface pressure in the contact area is reduced on the one hand and the contact surface is increased on the other hand. The invention has the additional object of constructing the contact element in such a way that a soft spring characteristic is obtained which, moreover, can be freely selected within a wide range in manufacturing the contact element. This object is met according to the invention in that the boundary edges of the projections provided for making contact extend in a straight line and enclose an acute angle with the center axis of the contact element when the latter is not loaded, which acute angle corresponds to the deflecting angle of the legs when the pin-shaped or strip-shaped contact element is inserted, and a crosspiece or web leading to the terminal lug of the contact element adjoins its rear central portion, and the contact element is substantially shaped like a tuning fork.

The invention is explained more fully with reference to an embodiment example and the drawing.

DESCRIPTION OF THE PREFERRED EMBODIMENTS

Figure 1:
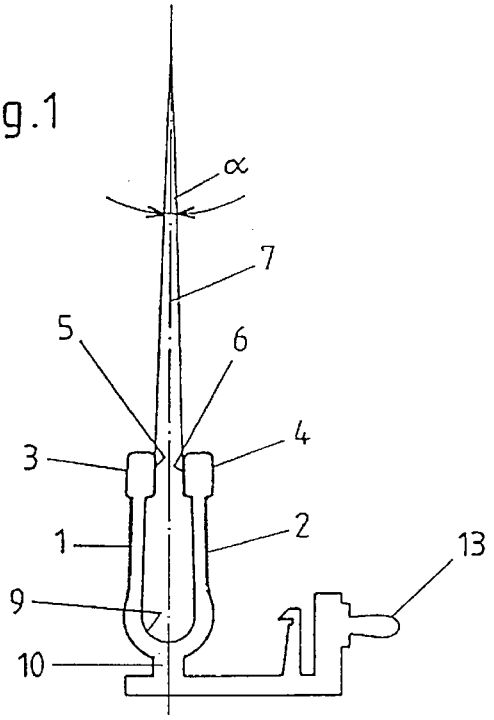
FIG. 1 shows a plan view of the contact element.
Figure 2:
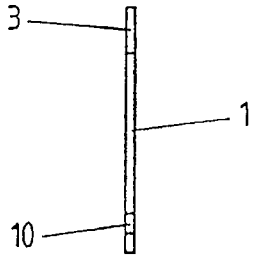
FIG. 2 shows a side view of the contact element.

The contact element shown in FIGS. 1 and 2 is stamped out of suitable electrically conducting sheet metal. It is shaped like a tuning fork and has two legs 1 and 2 which are inclined slightly relative to one another in the present case. Projections 3 and 4 which are directed opposite one another are formed integral with the free ends of these two legs 1 and 2. The boundary edges 5 and 6 provided for making contact with a contact element to be inserted extend in a straight line and enclose an acute angle $\alpha$ with the center axis 7 of the contact element. This acute angle $\alpha$ corresponds to the deflecting angle of the legs when a contact element 8 in the form of a pin or strip is inserted. As will be seen from FIG. 3, a relatively large contact zone is created in this way, more particularly along the boundary edges 5 and 6 which run in a straight line. The contact pressure or surface pressure between the contact-making parts is adjustable within wide limits in that the portion of the contact element remote of the projections 3 and 4 is constructed as a curve 9 whose center portion adjoins a web 10 leading to the terminal lug 13. In the embodiment example shown in the drawing, the curve 9 connecting legs 1 and 2 is wider than the legs (as measured in the plane of the contact element—the drawing plane in FIGS. 1 to 3). The spring hardness of the contact element can be selected within wide limits by the selection of the width of this curve. The outer contour of the legs 1 and 2 advisably merges smoothly with the outer contour of the curve 9 connecting the legs. The stiffness of the fork-like contact element changes as a function of the selected width of this curve 9.

Figure 4:
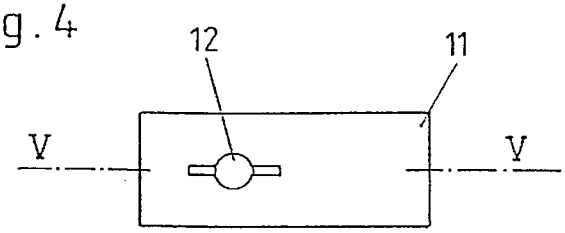
FIGS. 4 and 5 show the arrangement of the contact element according to FIG. 1 in an electrically insulating contact element support in a top view and in section along line V—V in FIG. 4.
Figure 5:
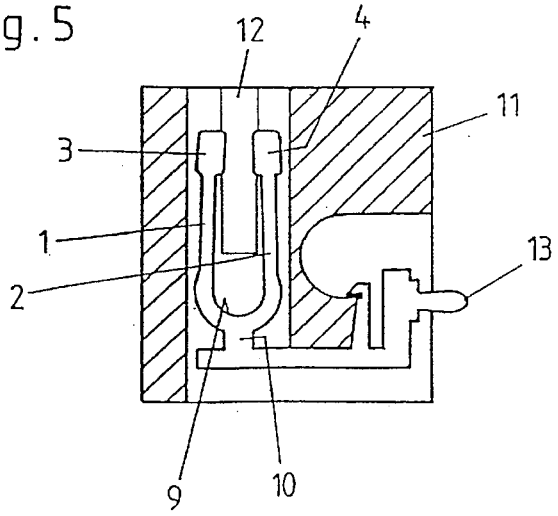

The receptacle opening 12 for a contact element of the type according to the invention in an electrically insulating contact element support 11 is shown in a top view in FIG. 4 and in section in FIG. 5.

Figure 3:
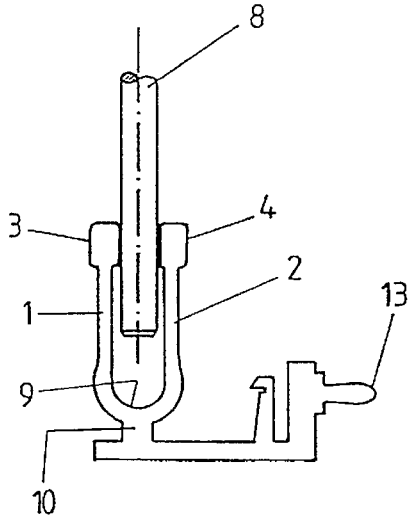
FIG. 3 shows the contact element according to FIG. 1 with inserted contact pin.

In the embodiment example shown in FIGS. 1 and 3, not only the straight boundary edges 5 and 6 of projections 3 and 4, but also the legs 1 and 2 supporting these boundary edges 5, 6 are inclined relative to one another when the contact element is not loaded. It lies within the scope of the present invention to construct the fork-like contact element in such a way that the two legs 1 and 2 extend parallel to one another when the contact element is not loaded. Nevertheless, projections 3 and 4 are to be so constructed that the contact-making boundary edges 5 and 6 of these projections are inclined relative to one another and thus, together with the center axis of the U-shaped contact element, enclose the acute angle $\alpha$ which corresponds to the deflecting angle of legs 1 and 2 when a mating contact element in the form of a pin or strip is inserted. The contact-making elements are dimensioned and adapted to one another in such a way that when the pin-shaped or strip-shaped contact element is inserted the straight boundary edges 5 and 6 of projections 3 and 4 contact the surface of the inserted contact element along their length. As a result, when the contact element 8 is inserted the deflecting angle of the legs 1 and 2 is equal to the angle $\alpha$ enclosed jointly by these straight boundary edges 5 and 6 when the contact is not loaded.

While the foregoing description and drawings represent the preferred embodiments of the present invention, it will be obvious to those skilled in the art that various changes and modifications may be made therein without departing from the true spirit and scope of the present invention.

What is claimed is:

1. In a first contact element for electrical connectors, in particular audio connectors, which is stamped out of a starting material in sheet form and has two fork-like legs having projections directed opposite one another at free ends of the legs for the purpose of making contact diametrically with a contact element which can be inserted between the fork-like legs, the improvement comprising that:

the projections provide contact-making boundary edges which extend in a plane and enclose an acute angle with the center axis of the first contact element when the contact element is not inserted between the fork-like legs, said acute angle corresponding to a deflecting angle of the legs when the second contact element is insert;

web leading leading to a terminal lug of first the contact element adjoins a rear central portion of the first contact element; and wherein the contact element is substantially shaped like a tuning fork to produce an extended region of contact between said edges and the second contact element.

2. The first contact element according to claim 1, wherein a portion of the first contact element remote of the projections is constructed as a curve.

3. The first contact element according to claim 2, wherein the curve connecting the legs is somewhat wider than the legs as measured in the plane of the contact element.

4. The first contact element according to claim 3, wherein the widening of the curve is situated at an outer side thereof.

5. The first contact element according to claim 2, wherein an outer contour of legs passes smoothly into the outer contour of the curve connecting the legs.

6. In a first contact element for an electrical connector, said first contact element having first and second legs, said first and second legs having first and second projections, respectively, said first and second projections being located at a free end of said first and second legs, respectively, and protruding into a central space, said first and second projections providing first and second contact surfaces, respectively, for making contact with a second contact element when the second contact element is inserted into the central space, said first and second legs of said first contact element being moveable between a rest position and a contact position, wherein the improvement comprises:

said first and second contact surfaces defining first and second planes, respectively, said rest position of said first contact element being occupied when the second element is not inserted into the central space and when said first plane and said second plane form an acute angle therebetween.

7. The improvement of claim 6 wherein the contact position of said first contact element is occupied when the second element is inserted into the central space to contact said contact surfaces and when said first plane and said second plane are substantially parallel.

8. The improvement of claim 6 wherein said first leg is connected to said second leg by a spring member.

9. The improvement of claim 8 wherein the spring member is curved.

10. The improvement of claim 8 wherein said spring member and said contact surfaces each have a thickness, the thickness of said spring member being greater than the thickness of the contact surfaces.

11. The improvement of claim 10 wherein said first and second legs each have an inner contour in a region between each of said contact surfaces and said spring member, and wherein said spring member has an inner contour, said inner contours of said first and second legs passing smoothly into said inner contour of said spring member.

12. The improvement of claim 8 wherein said spring member and said first and second legs each have an outer contour, said outer contour of said first and second legs passing smoothly into said outer contour of said spring member.

13. The improvement of claim 8 further comprising a web and a terminal lug, said web adjoining said spring member to said terminal lug.

14. The improvement of claim 6 wherein said first contact element is substantially shaped like a tuning fork.

* * * * *